US005180056A

United States Patent [19]

Adams et al.

[11] Patent Number: 5,180,056

[45] Date of Patent: Jan. 19, 1993

[54] DUAL CARTON

[75] Inventors: John M. Adams, Mechanicsville; Christopher N. Chance, Richmond; James A. DeBlasio, Midlothian; Donald H. Evers, Richmond; Michael A. Kirby, Sr., Trevilians; Reginald W. Newsome, Richmond; Robert E. Talley, Chester, all of Va.

[73] Assignee: Philip Morris Incorporated, New York, N.Y.

[21] Appl. No.: 829,375

[22] Filed: Feb. 3, 1992

Related U.S. Application Data

[63] Continuation-in-part of Ser. No. 774,529, Oct. 8, 1991.

[51] Int. Cl.[5] ..... B65D 85/10; B65D 5/54

[52] U.S. Cl. ..... 206/256; 206/813; 206/273; 229/120.011; 53/462; 53/448

[58] Field of Search ..... 53/448, 449, 462, 416, 53/466, 443; 206/813, 273, 271, 256; 229/120.011, 120.09

[56] References Cited

U.S. PATENT DOCUMENTS

| | | | |
|---|---|---|---|
| 2,109,583 | 3/1938 | Bennett | 206/813 |
| 2,390,412 | 12/1945 | Axberg | 229/51 |
| 2,565,509 | 8/1951 | Marcin | 206/813 |
| 2,605,897 | 8/1952 | Rundle | 206/264 |
| 2,697,544 | 12/1954 | Morand | 229/120.04 |
| 2,871,080 | 1/1959 | Shelley | 229/120.01 |
| 2,895,601 | 7/1959 | Krukonis | 206/256 |
| 3,071,244 | 1/1963 | Doran | 206/273 |
| 3,082,929 | 3/1963 | Aquino et al. | 206/256 |
| 3,086,650 | 4/1963 | Chapman et al. | 206/273 |
| 3,113,673 | 12/1963 | Stein | 206/65 |
| 3,135,457 | 6/1964 | Risucci | 229/120.011 |
| 3,144,190 | 8/1964 | Holt et al. | 229/27 |
| 3,163,351 | 12/1964 | Borgardt | 206/256 |
| 3,447,733 | 6/1969 | Smith et al. | 206/491 |
| 3,503,568 | 3/1970 | Galley | 242/74 |
| 3,536,246 | 10/1970 | Rosen | 206/256 |
| 3,596,758 | 8/1971 | Phillips, Jr. et al. | 206/256 |
| 3,721,335 | 3/1973 | Grant | 206/256 |
| 3,752,308 | 8/1973 | Begemann | 206/273 |
| 3,759,378 | 9/1973 | Werth | 206/429 |
| 3,809,227 | 5/1974 | Begemann | 206/264 |
| 4,424,658 | 1/1984 | Focke | 53/398 |
| 4,441,611 | 4/1984 | Sommariva | 206/431 |
| 4,485,926 | 12/1984 | Lenzmeier | 206/602 |
| 4,631,900 | 12/1986 | Mattei et al. | 53/448 |
| 4,669,611 | 6/1987 | Flaherty | 206/449 |
| 4,738,359 | 4/1988 | Phillips, Jr. | 206/256 |
| 4,928,817 | 5/1990 | Focke | 206/264 |
| 4,932,534 | 6/1990 | Focke et al. | 206/602 |
| 5,058,363 | 10/1991 | Focke et al. | 53/462 |

FOREIGN PATENT DOCUMENTS 358560 10/1931 United Kingdom .

*Primary Examiner*—William I. Price

*Attorney, Agent, or Firm*—Jeffrey H. Ingerman; Karen G. Horowitz

[57] ABSTRACT

A dual carton formed from two cartons each having at least one pair of opposed top flaps. One carton has an extended top flap which extends over the other carton when the cartons are positioned adjacent one another such that the extended top flap may be secured to the top flaps of the other carton to thereby join the two cartons to form a dual carton. The extended portion of the extended top flap is joined to the remainder of the extended top flap along a weakened line to facilitate later separation of the two joined cartons. The dual carton may be a cigarette carton of dimensions compatible with tax-stamping machinery and temporarily sealed in such a manner as to facilitate the opening and later resealing of the carton for tax-stamping purposes.

47 Claims, 4 Drawing Sheets

FIG. 3
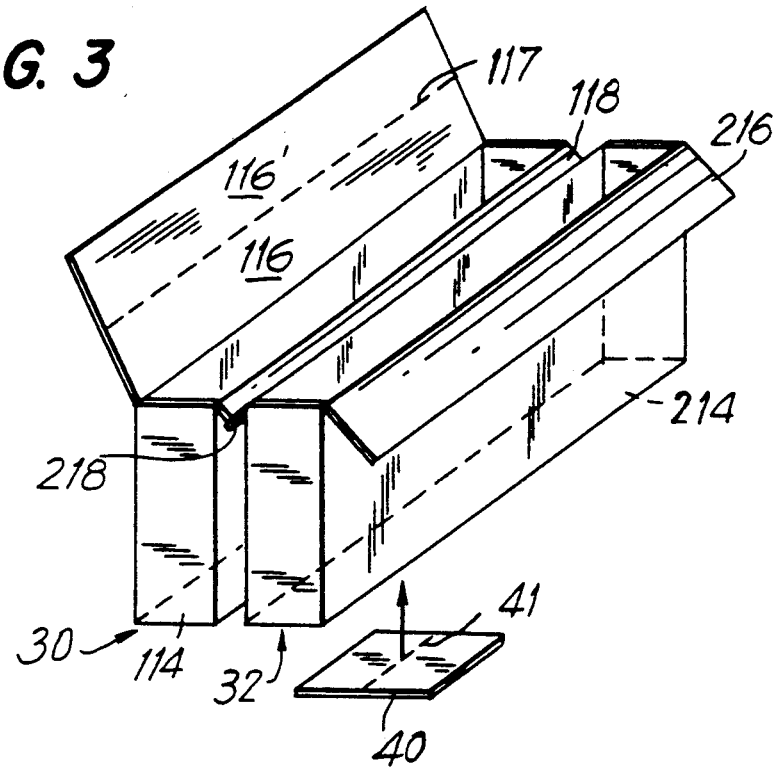
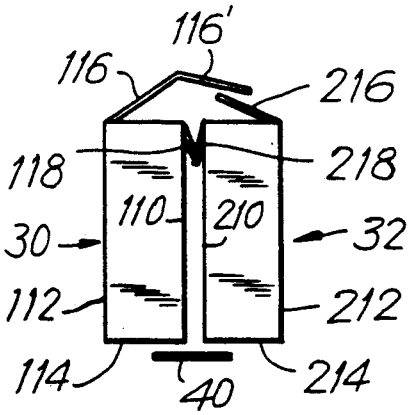
FIG. 4
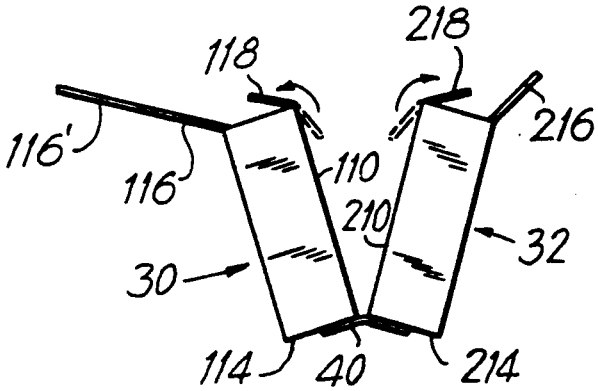
FIG. 5

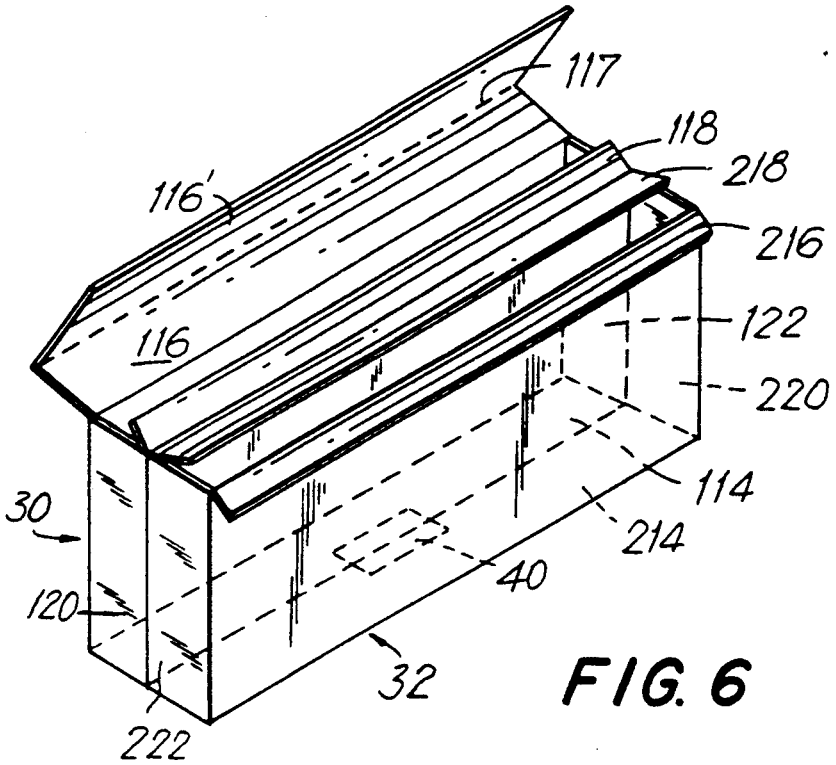
FIG. 6
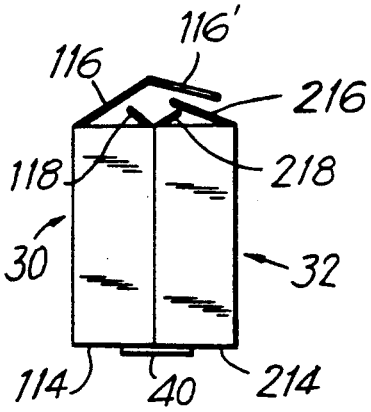
FIG. 7
FIG. 8
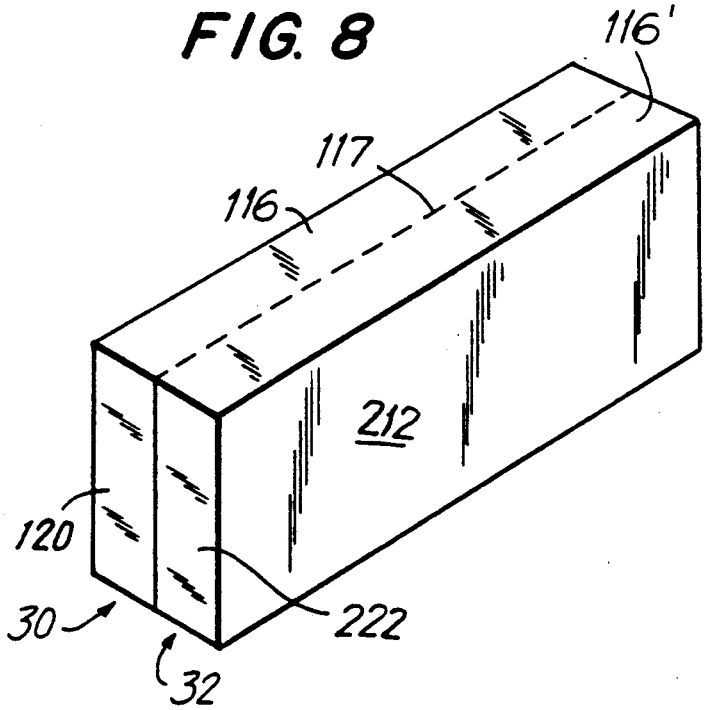

DUAL CARTON

CROSS REFERENCE TO RELATED APPLICATION

This application is a continuation-in-part of copending, commonly-assigned U.S. patent application Ser. No. 07/774,529, filed Oct. 8, 1991, which is hereby incorporated by reference in its entirety.

BACKGROUND OF THE INVENTION

The present invention relates to the connection of two cartons to form a dual carton, and more particularly to the connection of cigarette cartons.

Cigarette packs are generally rectangular in shape, having front and back long walls connected by two short side walls. Cigarette packs are typically packaged by the manufacturer in cigarette cartons, and are arranged so that the front long walls of the packs are in the same plane and the back long walls are in a parallel plane spaced from the plane of the front long walls. The filled cartons are usually temporarily closed and shipped to various distributors. The distributors generally open the cartons to apply the tax stamp that may be required by the jurisdiction in which they operate to an end of each cigarette pack while the packs are still inside the cartons. Such procedures are commonly automated, to reduce time, cost, and labor, through the use of specially designed machines for applying tax stamps. Tax-stamping machines have been developed to open the cartons, apply the stamps, and finally seal the cartons for distribution. Such machines are generally commercially available, and are well known in the art. These machines have been developed for ten-pack cartons, i.e., cartons containing two rows of five cigarette packs per row. A typical tax-stamping machine is model FUSON manufactured by Meyercord of 365 East North Avenue, Carol Stream, Ill. 60187.

Single row cigarette cartons which are dimensioned to contain one row of five cigarette packs (five columns of cigarette packs), i.e., five-pack cartons, are also known in the art. However, although machinery exists for manufacturing such cartons, machinery does not exist for stamping the cigarette packs contained in such cartons. Consequently, such single row cartons must either be hand-stamped (as is done currently) or would have to be secured together in pairs in order to be run through the existent commercially available tax-stamping equipment in which double row cartons are stamped. To assure that the tax stamp is properly registered, the means for securing the cartons must be strong enough to keep the cartons together such that they are not sheared apart by the vertical rollers of the tax-stamping machines which roll along the vertical walls of the cartons to transfer the cartons between the various stages of the process.

Although single row cartons may be sufficiently secured together such that they may be passed through commercially available tax-stamping equipment, other problems which occur during tax-stamping must be addressed. One major disadvantage of using commercially available tax-stamping equipment for processing cartons for which the equipment was not designed is that the equipment usually does not adequately handle cartons having top flap configurations which are different from flap configurations on cartons ordinarily processed. Tax-stamping machines generally include equipment which opens the temporarily closed cartons so that the ends of the cigarette packs are accessible for application of a tax stamp. Tax-stamping machines also generally include equipment which closes the cartons after the tax stamp is applied, so that the carton is in condition for distribution to consumers. Commercially available tax-stamping machines, designed for processing ten-pack cartons, often cannot handle the top flaps of a pair of five-pack cartons which are secured together to open and later close the cartons adequately. Thus, such flaps interfere with the tax-stamping process.

After the cigarette cartons are passed through a tax-stamping machine, the individual cartons must be sealed so that they may be distributed for sale. It would be desirable to seal the cartons such that they may be sold together, as a dual carton, or, alternatively, such that they may be separated before reaching the consumer or separated by the consumer without disfiguring either of the individual cartons.

SUMMARY OF THE INVENTION

It is therefore an object of the invention to provide two individual cartons joined as a dual carton of dimensions compatible with commercially available tax-stamping machinery, each individual carton configured such that a commercially available tax-stamping machine can adequately handle the top flaps of the dual carton.

It is another object of the invention to provide a means for joining and sealing two individual cartons such that the cartons may be sold together as a dual carton, without the means for joining and sealing the individual cartons being readily apparent.

It is a further object of the invention to provide a means for joining and sealing two individual cartons to form a dual carton such that the dual carton resembles an individual carton of the same dimensions as the dual carton.

It is yet another object of the invention to provide means for making a clean separation between two individual cartons initially joined together so that the individual cartons may be sold separately with minimal marks left from the means for joining the cartons.

These and other objects of the invention are accomplished in accordance with the principles of the invention by joining two individual cartons having top flap configurations which resemble the top flap configurations of a single carton when the individual cartons are joined to form a dual carton. The dual carton is dimensioned so that it may be passed through commercially available equipment, and the top flaps are dimensioned such that they may be opened by commercially available equipment designed to open individual cartons of the same dimensions as the dual carton. The dual carton is sealed after tax-stamping so that the dual carton resembles an individual carton of the same dimensions as the dual carton, and so that the individual cartons may be separated without leaving noticeable marks where the cartons were originally joined.

BRIEF DESCRIPTION OF THE DRAWINGS

Further features of the invention, its nature and various advantages will be more apparent from the following detailed description of the preferred embodiments and the accompanying drawings wherein like reference characters represent like elements throughout, and in which:

FIG. 3 is an exploded isometric view of two five-pack cartons, one formed from a blank such as shown in FIG. I, and the other formed from a blank such as shown in FIG. 2, the cartons positioned adjacent one another to be joined for tax-stamping purposes in accordance with this invention;

FIG. 4 is an exploded side view of two five-pack cartons such as shown in FIG. 3, positioned adjacent one another to be joined for tax-stamping purposes in accordance with this invention;

FIG. 5 is a side view of a step taken in preparing the two five-pack cartons of FIGS. 3 and 4 to be sealed for distribution as a dual carton;

FIG. 6 is an isometric view of two five-pack cartons, such as shown in FIGS. 3–5, positioned and prepared to be sealed for distribution as a dual carton;

FIG. 7 is a side view of a step taken in sealing the two five-pack cartons of FIG. 6;

FIG. 8 is an isometric view of the two five-pack cartons of FIGS. 6 and 7, after the cartons are sealed to form a dual carton.

DETAILED DESCRIPTION OF THE INVENTION

Figure 1:
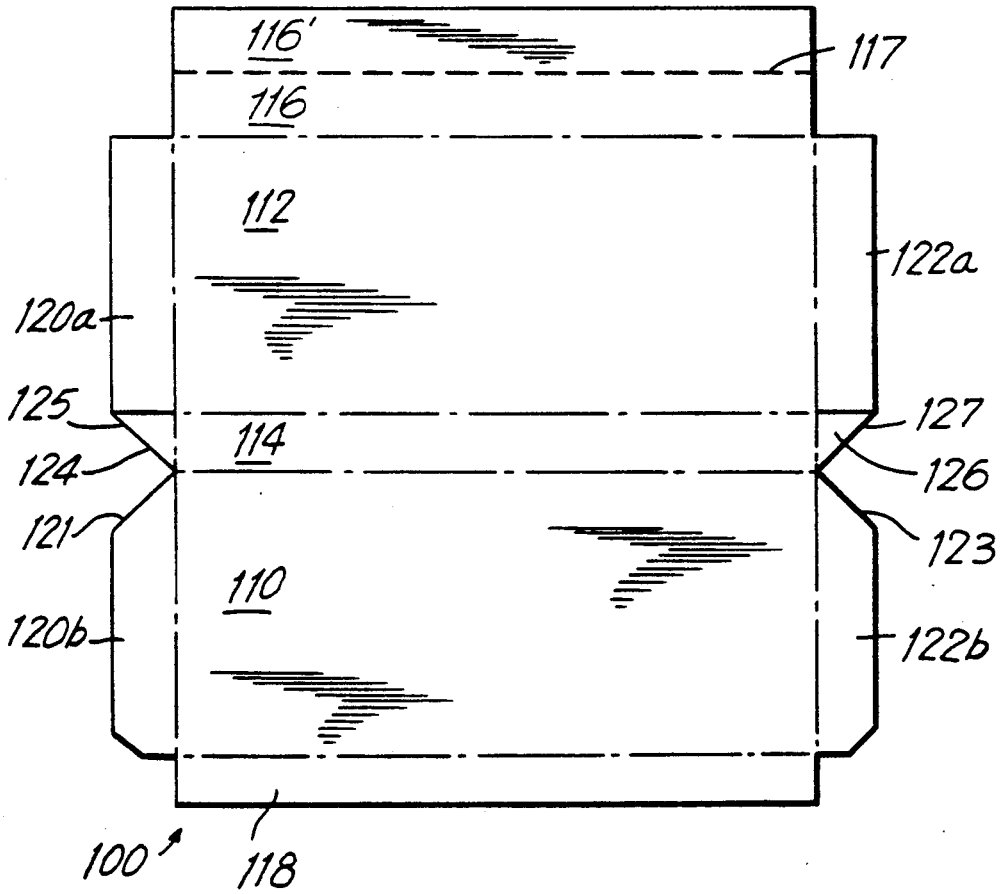
FIG. 1 is a plan view of an illustrative carton blank for one of the five-pack cartons of the dual carton of this invention.
Figure 2:
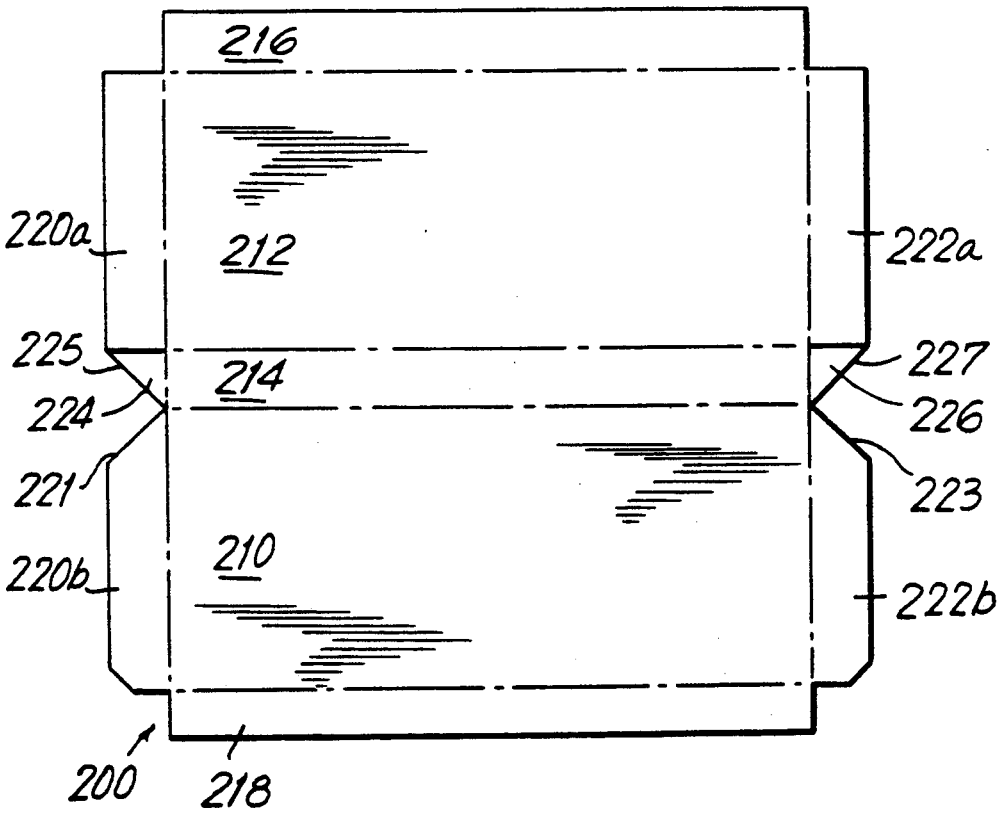
FIG. 2 is a plan view of an illustrative carton blank for the other of the five-pack cartons of the dual carton of this invention.

The dual carton of this invention is formed from two similar cartons formed from blanks 100 and 200, shown in FIG. 1 and FIG. 2, respectively. Blanks 100 and 200 are preferably formed from substantially stiff material such as cardboard or paperboard, and have corresponding front panels 110 and 210, rear panels 112 and 212, and bottom panels 114 and 214, respectively. Panels 120*a*, 120*b*, 122*a*, and 122*b* form side walls of carton 30, formed from blank 100. Corresponding panels 220*a*, 220*b*, 222*a*, and 222*b* form side walls of carton 32, formed from blank 200. Dust flaps 124, 126, 224, and 226 of blanks 100 and 200, are preferably folded perpendicular to bottom panels 114 and 214 when the blanks are folded into cartons. preferably, "b" panels 120*b*, 122*b*, 220*b*, and 222*b* have angled edges 121, 123, 221, and 223, respectively, which align with edges 125, 127, 225, and 227 of dust flaps 124, 126, 224, and 226, respectively, and are folded before "a" panels 120*a*, 122*a*, 220*a*, and 222*a* are folded so that the "b" panels lie adjacent the interior of the carton and the "a" panels lie adjacent the exterior. Top flaps/extension panels 118 and 218 of blanks 100 and 200 are similar, as well. Panels 118 and 218 may be the same dimension as bottom panels 114 and 214, or may be narrower so that they do not extend from the front panel, from which they extend, completely to the opposite rear panel, when the blanks are folded into cartons. Panels 118 and 218 may extend half the distance between the front panel and the rear panel of the cartons formed from their respective blanks. The functions of panels 116, 116', and 216 differ, as will be discussed, and therefore these panels do not correspond to one another as do the other panels of blanks 100 and 200. Panel 116 extends across the entire distance between rear panel 112, from which panel 116 extends, and front panel 110, when blank 100 is folded into carton 30, so that panels 116 and 114 are substantially the same dimension. Panel 116', which extends from the distal edge of panel 116 along a weakened line such as perforated line 117, is preferably the same dimension as panel 116, but may be slightly shorter, i.e., if folded along line 117 over panel 116, the free edge of 116' would not reach the proximal edge of panel 116 along rear panel 112. Panel 216 of blank 200 may either be the same dimension as panel 218 or the same dimension as panel 214, or any intermediate dimension. Panel 216 is preferably the same dimension as panel 214.

Blanks 100 and 200 are folded along fold lines, represented by unlabeled broken lines in FIGS. 1 and 2, to form five-pack cartons 30 and 32, respectively. Each carton is preferably dimensioned to hold one row of five cigarette packs aligned with their short walls abutting adjacent short walls and their long walls aligned in two spaced apart parallel planes. Cartons 30 and 32 are shown positioned next to one another in FIG. 3 in preparation for joining to form a dual carton which, as a unit, would hold two rows and five columns (i.e., five packs per row) of cigarette packs. A carrier means bearing adhesive, such as described in aforementioned patent application Ser. No. 07/774,529, is positioned across the bottom walls of the cartons. For example, label 40, preferably having a weakened line, such as perforated line 41, is positioned across bottom walls 114 and 214 of cartons 30, 32 to thereby join the cartons. Perforated line 4 is preferably positioned along the adjoining abutting edges of bottom walls 114 and 214 to facilitate later separation of the cartons, if desired. Label 40 may bear pricing indicia, such as U.P.C. (Universal Product Code) indicia, such as described in copending, commonly assigned patent application Ser. No. 07/792,617 filed Nov. 15, 1991, which is hereby incorporated by reference in its entirety. Additional labels (not shown), similar to label 40, may be applied across the adjacent coplanar side walls of the cartons to more securely join the two cartons. Cartons 30, 32 are joined such that walls 110 and 210 are adjacent one another with their boundaries coextensive, and with panels/flaps 118 and 218 folded down and positioned between walls 110 and 210, for reasons as will become apparent. Since panels 120*a*, 122*a*, 220*a*, and 222*a* (the "a" panels) are preferably folded over panels 120*b*, 122*b*, 220*b*, and 222*b* (the "b" panels), respectively, the free edge of each of the "a" panels faces inwardly, between the two cartons. In this configuration, the free edges are relatively safe from being accidentally lifted from their place adjacent the "b" panels, because the free edges are not readily accessible.

The joined cartons are closed, as shown in FIG. 4, in preparation for shipment to a distributor. As described above, panel/flap 216 extends the entire distance between walls 110 and 112 such that line 117 lies above the plane of abutment of cartons 30 and 32. Panel/flap 216 is folded over carton 32 and panel/flap 116' is folded over carton 32 above panel/flap 216 and is secured with releasable adhesive (any known releasable adhesive which preferably does not cause fiber pull and does not leave a tacky residue) to flap 216 to temporarily close the dual carton formed by cartons 30, 32. Flap 116' is preferably the same dimension as flap 116 so that the free edge of flap 116' lies substantially along the top of panel 212, along the proximal edge of flap 216.

The dual carton formed by cartons 30, 32 now may be passed through commercially available tax-stamping machinery, adapted to process ten-pack cigarette cartons. Tax-stamping machines are typically designed to open and reseal cartons which have a flap on each wall. Hence, it is preferable that cartons 30, 32 be joined as shown in FIG. 2 with panels/flaps 118 and 218 positioned between walls 110 and 210, so that only flaps 116 (and connected flap 116') and 216 must be lifted to open the cartons. The combined flap 116, 116' and flap 216 are of equivalent dimensions of the corresponding flaps of a ten-pack cigarette carton and hence the dual cartons may be passed through a tax-stamping machine without much difficulty caused by flap configurations of the individual cartons being of different dimensions than a larger single carton. Once the required tax stamp is applied to the cigarette packs contained within the individual cartons, the cartons are ready to be sealed and distributed for sale to consumers.

The initial step in sealing cartons 30, 32 is shown in FIG. 5. The cartons are pivoted along label 40, which joins the cartons, so that flaps 118 and 218 may be removed from between walls 110 and 210, and folded over the tops of the cartons. If labels such as label 40 are placed across adjacent side walls of cartons 30, 32, such additional labels must be severed before this step.

After flaps 118 and 218 are folded over their respective cartons, the cartons are positioned, once again, with panels 110 and 210 adjacent and coextensive with one another, as shown in FIG. 6. The carton is now sealed, as shown in FIG. 7, in a similar manner as shown in FIG. 4, except with flaps 118 and 218 over the tops of the individual cartons instead of between the cartons. The portion of flap 116 which is folded over flap 118 is secured to flap 118 with preferably releasable adhesive to facilitate the opening of carton 30, when separated from carton 32, by lifting flap 116. Releasable adhesive is also applied over flap 218 to facilitate the opening of carton 32, when separated from carton 30, by lifting flap 116'. Either flap 116' or 216 is secured to flap 218, depending on the dimension of flap 216. If flap 216 is substantially the same dimension as flap 116', preferably flap 216 is secured to flap 218 and flap 116' is secured to flap 216. If, however, flap 216 is substantially the same dimension as flap 218, both extending approximately half the distance between panels 210 and 212, flap 116' is secured to flap 218 and to flap 216. Flap 116' is then secured to flap 216 with preferably permanent adhesive. If, however, it is desired that the dual carton be distributed in the dual carton configuration and possibly purchased as a dual carton, releasable adhesive may be used between flaps 116' and 216, to facilitate the opening of the dual carton by lifting flap 116' from above 216. The joined and sealed cartons are shown in the dual carton configuration in FIG. 8 with a single flap formed from flaps 116 and 116' over both cartons 30 and 32. Line 117 is positioned so that the cartons may be easily separated for individual sale as two separate five-pack cartons.

Separation of cartons 30, 32 includes separation of flaps 116 and 116'. Because flap 116 is secured to flap 118 of carton 30, flap 116 remains as the top flap of carton 30. At the same time, because flap 116' is secured to flap 216 (and possibly also to flap 218) of carton 32, flap 116' remains a part of carton 32, forming a part of a laminated top flap with flap 216.

Although cartons 30, 32 are described as each dimensioned to hold one row of five cigarette packs, they may be lengthened or shortened to hold more or fewer than five packs. Furthermore, it will be appreciated that these concepts may be applied to the connection of cartons of other configurations.

It will be appreciated that either releasable adhesive or permanent adhesive may be applied to flaps 118, 218 and 216, the choice of adhesive not being limited to the choices described above.

It will be appreciated that references to cigarette cartons and cigarette packs are not limited to only rectangular cartons and packs, but are intended to include all configurations which are available to consumers. Cigarette cartons include cartons with windows, cartons with rounded edges, and other configurations which are designed to be passed through tax-stamping equipment. Cigarette packs include such packs as oval packs, packs with rounded edges, and other non-rectangular shapes.

It will be appreciated that references to tax-stamping machinery are intended to include any existing equipment which is readily available to distributors, and modified versions.

It will be appreciated that the directional references "top," "bottom," "front," and "rear" do not limit the respective panels to such orientation, but merely serve to distinguish these panels from one another.

It will be understood that the foregoing is merely illustrative of the principles of the invention, and that various modifications can be made by those skilled in the art without departing from the scope and spirit of the invention. For example, such connection of cartons may be applied to any cartons, and is not limited to cigarette cartons. The present embodiments are described for the purpose of illustration rather than limitation, and the present invention is limited only by the claims which follow.

What is claimed is:

1. A dual carton comprising:

a first carton second ends, a first pair of first and second opposed walls, and a second pair of third and fourth opposed walls; each said first, second, third, and fourth wall having a first edge adjacent said first end and a second edge adjacent said second end;

a first extension panel extending from said first edge of said first wall and having a distal edge which lies adjacent said first edge of said second wall when said first extension panel is folded substantially perpendicular to said first wall, towards said second wall;

a second extension panel extending from said first edge of said second wall and having a free edge; and a third extension panel extending from said distal edge of said first extension panel and having a free edge; said dual carton further comprising:

a second carton having first and second ends, a first pair of first and second opposed walls, and a second pair of third and fourth opposed walls; each said first, second, third, and fourth wall having a first edge adjacent said first end and a second edge adjacent said second end; said second carton further comprising:

a first extension panel extending from said first edge of said first wall and having a free edge; and a second extension panel extending from said first edge of said second wall and having a free edge; wherein:

said first and second cartons are positioned adjacent one another with said second wall of said first carton adjacent and coextensive with said second wall of said second carton such that the borders of said coextensive walls are aligned to form said dual carton; and said third extension panel of said first carton extends between said first edges of said first and second walls of said second carton when said first and third extension panels of said first carton are folded towards said second carton such that said second carton may be joined to said first carton to form said dual carton by securing said third extension panel to said second carton.

2. The dual carton of claim 1 wherein said first and third extension panels of said first carton are joined along a line of weakness.

3. The dual carton of claim 2 wherein said line of weakness comprises a line of perforations.

4. The dual carton of claim 2 wherein said line of weakness is positioned along the plane of abutment of said second walls of said first and second cartons when said first and third extension panels of said first carton are folded substantially perpendicular to said first and second walls of said first and second cartons and towards said second carton.

5. The dual carton of claim 1 wherein:

said first carton has a bottom wall extending at least from said second edge of said first wall to said second edge of said second wall; and said second carton has a bottom wall extending at least from said second edge of said first wall to said second edge of said second wall; said dual carton further including:

joining means secured across said bottom walls of said first and second cartons.

6. The dual carton of claim 5 wherein:

said joining means is a carrier means bearing adhesive on one side; and said carrier means is positioned across said bottom walls of said first and second carton with said adhesive bearing side in operative contact with said bottom walls.

7. The dual carton of claim 6 wherein said carrier means includes a line of weakness positioned along the adjoining abutting edges of said bottom walls of said first and second cartons.

8. The dual carton of claim 7 wherein said line of weakness comprises a line of perforations.

9. The dual carton of claim 1 wherein:

said second extension panel of said first carton is folded substantially perpendicular to said second wall of said first carton such that said free edge of said second extension panel of said first carton lies between said first edges of said first and second walls of said first carton;

said second extension panel of said second carton is folded substantially perpendicular to said second wall of said second carton such that said free edge of said second extension panel of said second carton lies between said first edges of said first and second walls of said second carton;

said first extension panel of said second carton is folded substantially perpendicular to said first wall of said second carton such that said free edge of said first extension panel of said second carton lies between said first edges of said first and second walls of said second carton;

said first extension panel of said first carton is folded over said second extension panel of said first carton such that said distal edge of said first extension panel lies adjacent said first edge of said second wall of said first carton and along the plane of abutment of the first and second cartons; and said third extension panel of said first carton is folded over said second carton and said first and second extension panels of said second carton.

10. The dual carton of claim 9 wherein said third extension panel of said first carton is secured to said first extension panel of said second carton.

11. The dual carton of claim 10 wherein said third extension panel of said first carton is secured to said first extension panel of said second carton with permanent adhesive.

12. The dual carton of claim 10 wherein:

said free edges of said first and second extension panels of said second carton lie adjacent one another when said first extension panel of said second carton is folded substantially perpendicular to said first wall of said second carton and towards said second wall of said second carton and said second extension panel of said second carton is folded substantially perpendicular to said second wall of said second carton and towards said first wall of said second carton;

said first extension panel of said first carton is secured to said second extension panel of said first carton; and said third extension panel of said first carton is secured to said second extension panel of said second carton.

13. The dual carton of claim 12 wherein:

said first extension panel of said first carton is secured to said second extension panel of said first carton with releasable adhesive;

said third extension panel of said first carton is secured to said second extension panel of said second carton with releasable adhesive; and said third extension panel of said first carton is secured to said first extension panel of said second carton with permanent adhesive.

14. The dual carton of claim 10 wherein:

said free edge of said first extension panel of said second carton lies adjacent said first edge of said second wall of said second carton when said first extension panel of said second carton is folded substantially perpendicular to said first wall of said second carton and towards said second wall of said second carton;

said free edge of said second extension panel of said second carton lies between said first edges of said first and second walls of said second carton when said second extension panel of said second carton is folded substantially perpendicular to said second wall of said second carton and towards said first wall of said second carton;

said first extension panel of said first carton is secured to said second extension panel of said first carton; and said first extension panel of said second carton is secured to said second extension panel of said second carton such that said first extension panel of said second carton is secured between said second extension panel of said second carton and said third extension panel of said first carton.

15. The dual carton of claim 14 wherein:

said first and second panels of said first carton are secured together with releasable adhesive;

said first and second panels of said second carton are secured together with releasable adhesive; and said third extension panel of said first carton is secured to said first extension panel of said second carton with permanent adhesive.

16. The dual carton of claim 9 wherein said first and third extension panels of said first carton are joined along a line of weakness along which said first and second cartons may be separated when in said dual carton configuration.

17. The dual carton of claim 16 wherein said line of weakness is a line of perforations.

18. The dual carton of claim 9 wherein:

said first carton has a bottom wall extending at least from said second edge of said first wall to said second edge of said second wall; and said second carton has a bottom wall extending at least from said second edge of said first wall to said second edge of said second wall; said dual carton further including:

joining means secured across said bottom walls of said first and second cartons.

19. The dual carton of claim 18 wherein:

said joining means is a carrier means bearing adhesive on one side; and said carrier means is positioned across said bottom walls of said first and second carton with said adhesive bearing side in operative contact with said bottom walls.

20. The dual carton of claim 19 wherein said carrier means includes a line of weakness positioned along the adjoining abutting edges of said bottom walls of said first and second cartons.

21. The dual carton of claim 20 wherein said line of weakness comprises a line of perforations.

22. The dual carton of claim 1 wherein:

said second extension panels of said first and second cartons are folded down between said second walls of said first and second cartons such that said second extension panels of said first and second cartons are positioned between said second walls of said first and second cartons;

said first extension panel of said second carton is folded substantially perpendicular to said first wall of said second carton so that said free edge of said first extension panel of said second carton lies between said first and second walls of said second carton;

said first extension panel of said first carton is folded substantially perpendicular to said first wall of said first carton so that said distal edge of said first extension panel of said first carton lies adjacent said first edge of said second wall of said first carton; and said third extension panel of said first carton is folded over and secured to said first extension panel of said second carton.

23. The dual carton of claim 22 wherein said third extension panel of said first carton is secured to said first extension panel of said second carton with releasable adhesive.

24. The dual carton of claim 22 wherein:

said first and second cartons each comprise a cigarette carton for packaging a first number of cigarette packs in each said carton, each said pack having a pair of front and rear long walls and a pair of opposed short walls;

the widths of said first and second walls of said first and second cartons are at least as wide as a second number of times the width of the long wall of said cigarette pack;

the widths of said third and fourth walls of said first and second cartons are at least as wide as a third number of times the width of the short wall of said cigarette pack;

said first number of cigarette packs, equal to the product of said second number of times the width of the long wall of said cigarette pack and said third number of times the width of the short wall of said cigarette pack, can be positioned inside each of said first and second cartons with said short walls of said packs parallel said third and fourth walls of said cartons, such that said dual carton contains twice said first number of cigarette packs and has dimensions compatible with commercially available tax-stamping equipment; and extension panels of said first and third extension panels of said first carton and said first extension panel of said second carton are positioned adjacent s cigarette packs to be contained in said cartons.

25. The dual carton of claim 24 wherein said third extension panel of said first carton is secured to said first extension panel of said second carton with releasable adhesive such that said first extension panel of said second carton is positioned between said third extension panel and the interior of said second carton, and said third extension panel of said first carton may be lifted from said first extension panel of said second carton to lift said first and third extension panels of said first carton and said first extension panel of said second carton from their positions adjacent cigarette packs to be contained within said cartons to apply a tax stamp to an end of each cigarette pack contained within said cartons.

26. The dual carton of claim 24 wherein:

said first carton has a bottom wall extending at least from said second edge of said first wall to said second edge of said second wall; and said second carton has a bottom wall extending at least from said second edge of said first wall to said second edge of said second wall; said dual carton further including:

joining means secured across said bottom walls of said first and second cartons to secure said cartons together so that said cartons do not move relative to one another when said dual carton is passed through tax-stamping equipment.

27. A method for securing two cartons together to form a dual carton, said method comprising the steps of:

providing a first carton having first and second ends; a first pair of first and second opposed walls each having a first edge adjacent said first end and a second edge adjacent said second end; a second pair of third and fourth opposed walls each having a first edge adjacent said first end and a second edge adjacent said second end; a first extension panel extending from said first edge of said first wall and having a distal edge which lies adjacent said first edge of said second wall when said first extension panel is folded substantially perpendicular to said first wall and towards said second wall; a second extension panel extending from said first edge of said second wall and having a free edge; and a third extension panel extending from said distal edge of said first extension panel and having a free edge;

providing a second carton having first and second ends; a first pair of first and second opposed walls each having a first edge adjacent said first end and a second edge adjacent said second end; a second pair of third and fourth opposed walls each having a first edge adjacent said first end and a second edge adjacent said second end; a first extension panel extending from said first edge of said first wall and having a free edge; and a second extension panel extending from said first edge of said second wall and having a free edge;

positioning said first and second cartons adjacent one another with said second wall of said first carton adjacent and coextensive with said second wall of said second carton such that the borders of said coextensive walls are aligned;

folding said second extension panel of said first carton substantially perpendicular to said second wall of said first carton so that said free edge of said second extension panel lies between said first edges of said first and second walls of said first carton;

folding said second extension panel of said second carton substantially perpendicular to said second wall of said second carton so that said free edge of said second extension panel lies between said first edges of said first and second walls of said second carton;

folding said first extension panel of said second carton substantially perpendicular to said first wall of said second carton and toward said second wall of said second carton;

folding said first and third extension panels of said first carton substantially perpendicular to said first wall of said first carton and towards said second carton; and securing said third extension panel of said first carton to one of said first and second extension panels of said second carton to form said dual carton.

28. The method of claim 27 wherein said step of securing said third extension panel to one of said first and second extension panels of said second carton includes the step of securing said third extension panel to said first extension panel of said second carton.

29. The method of claim 28 wherein:

said free edges of said first and second extension panels of said second carton lie adjacent one another when said first extension panel of said second carton is folded substantially perpendicular to said first wall of said second carton and towards said second wall of said second carton and said second extension panel of said second carton is folded substantially perpendicular to said second wall of said second carton and towards said first wall of said second carton; said method further including the steps of:

securing said third extension panel to said second extension panel of said second carton; and securing said first extension panel of said first carton to said second extension panel of said first carton.

30. The method of claim 29 wherein:

said step of securing said third extension panel to said first extension panel of said second carton includes the step of securing said third extension panel to said first extension panel of said second carton with permanent adhesive;

said step of securing said third extension panel to said second extension panel of said second carton includes the step of securing said third extension panel to said second extension panel of said second carton with releasable adhesive; and said step of securing said first and second extension panels of said first carton together includes the step of securing said first and second extension panels of said first carton with releasable adhesive.

31. The method of claim 28 wherein:

said free edge of said first extension panel of said second carton lies adjacent said first edge of said second wall of said second carton when said first extension panel of said second carton is folded substantially perpendicular to said first wall of said second carton and towards said second wall of said second carton; and said free edge of said second extension panel of said second carton lies between said first edges of said first and second walls of said second carton when said second extension panel of said second carton is folded substantially perpendicular to said second wall of said second carton and towards said first wall of said second carton; said method further including the steps of:

securing said first extension panel of said first carton to said second extension panel of said first carton; and securing said first extension panel of said second carton to said second extension panel of said second carton such that said second extension panel of said second carton lies between said first extension panel of said second carton and the interior of said carton.

32. The method of claim 31 wherein said step of securing said third extension panel to said first extension panel of said second carton includes the step of securing said third extension panel to said first extension panel of said second carton with permanent adhesive;

said step of securing said first and second extension panels of said second carton together includes the step of securing said first and second extension panels of said second carton with releasable adhesive; and said step of securing said first and second extension panels of said first carton together includes the step of securing said first and second extension panels of said first carton with releasable adhesive.

33. The method of claim 27 further including the steps of:

providing a line of weakness along the line along which said first and third extension panels of said first carton are joined; and positioning said line of weakness along the plane of abutment of said first and second cartons such that said first and second cartons of said dual carton are separable along said line of weakness to facilitate later separation of said first and second cartons.

34. The method of claim 33 wherein said step of providing a line of weakness comprises the step of providing a line of perforations.

35. The method of claim 27 wherein:

said first carton has a bottom wall extending at least from said second edge of said first wall to said second edge of said second wall; and said second carton has a bottom wall extending at least from said second edge of said first wall to said second edge of said second wall; said method further including the step of:

positioning joining means across said bottom walls of said first and second cartons.

36. The method of claim 35 further including the steps of:

providing said joining means with a line of weakness; and positioning said joining means such that said line of weakness is substantially parallel the adjoining abutting edges of said bottom walls to facilitate later separation of said first and second cartons.

37. The method of claim 36 wherein said step of providing said joining means with a line of weakness includes the step of providing said joining means with a line of perforations.

38. A method for packaging cigarette packs which are to be passed through tax-stamping machinery used in the automated processing of cigarette cartons and later may be separated into groups of cigarette packs, said method comprising the steps of:

providing a first carton having first second ends; a first pair of first and second and opposed walls each having a first edge adjacent said first end and a second edge adjacent said second end; a second pair of third and fourth opposed walls each having a first edge adjacent said first end and a second edge adjacent said second end; a bottom wall extending at least from said second edge of said first wall to said second edge of said second wall; a first extension panel extending from said first edge of said first wall and having a distal edge which lies adjacent said first edge of said second wall when said first extension panel is folded substantially perpendicular to said first wall and towards said second wall; a second extension panel extending from said first edge of said second wall and having a free edge; and a third extension panel extending from said distal edge of said first extension panel and having a free edge;

providing a second carton having first and second ends; a first pair of first and second opposed walls each having a first edge adjacent said first end and a second edge adjacent said second end; a second pair of third and fourth opposed walls each having a first edge adjacent said first end and a second edge adjacent said second end; a bottom wall extending at least from said second edge of said first wall to said second edge of said second wall; a first extension panel extending from said first edge of said first wall and having a free edge; and a second extension panel extending from said first edge of said second wall and having a free edge;

folding said second extension panel of said first carton to lie adjacent the outside of said first carton adjacent said second wall of said first carton;

folding said second extension panel of said second carton to lie adjacent the outside of said second carton adjacent said second wall of said second carton;

positioning said first and second cartons adjacent one another with said second wall of said first carton adjacent and coextensive with said second wall of said second carton such that the borders of said coextensive walls are aligned, and with said second extension panels of said first and second cartons adjacent one another and between said first and second cartons;

positioning securing means across said bottom walls of said first and second cartons to secure said first and second cartons together to form a dual carton of dimensions compatible with available tax-stamping machinery;

folding said first extension panel of said second carton substantially perpendicular to said first wall of said second carton and towards said second wall of said second carton;

folding said first and third extension panels of said first carton substantially perpendicular to said first wall of said first carton and towards said second carton; and securing said third extension panel of said first carton to said first extension panel of said second carton with releasable adhesive to temporarily seal said first and second cartons, wherein:

said first extension panel of said second carton is positioned between said third extension panel and the interior of said second carton.

39. The method of claim 38 wherein:

said third extension panel of said first carton is lifted from said first extension panel of said second carton to apply a tax stamp to an end of each cigarette pack contained within said first and second cartons; said method further including the steps of:

pivoting said cartons about said bottom walls of said cartons to access said second extension panels;

folding said second extension panel of said first carton substantially perpendicular to said second wall of said first carton and towards said first wall of said first carton;

folding said second extension panel of said second carton substantially perpendicular to said second wall of said second carton and towards said first wall of said second carton;

folding said first extension panel of said second carton substantially perpendicular to said first wall of said second carton and towards said second wall of said second carton;

folding said first and third extension panels substantially perpendicular to said first wall of said first carton and towards said second carton; and securing said third extension panel to said first extension panel of said second carton.

40. The method of claim 39 wherein:

said first extension panel of said second carton is positioned between said third extension panel of said first carton and the interior of said second carton; and said free edges of said first and second extension panels of said second carton lie adjacent one another when said first extension panel of said second carton is folded substantially perpendicular to said first wall of said second carton and towards said second wall of said second carton and said second extension panel of said second carton is folded substantially perpendicular to said second wall of said second carton and towards said first wall of said second carton; said method further including the steps of:

securing said third extension panel to said second extension panel of said second carton; and securing said first extension panel of said first carton to said second extension panel of said first carton.

41. The method of claim 40 wherein:

said step of securing said third extension panel to said first extension panel of said second carton includes the step of securing said third extension panel to said first extension panel of said second carton with permanent adhesive;

said step of securing said third extension panel to said second extension panel of said second carton includes the step of securing said third extension panel to said second extension panel of said second carton with releasable adhesive; and said step of securing said first and second extension panels of said first carton together includes the step of securing said first and second extension panels of said first carton with releasable adhesive.

42. The method of claim 39 wherein:

said first extension panel of said second carton is positioned between said third extension panel of said first carton and the interior of said second carton;

said free edge of said first extension panel of said second carton lies adjacent said first edges of said second wall of said second carton when said first extension panel of said second carton is folded substantially perpendicular to said first wall of said second carton towards said second wall of said second carton; and said free edge of said second extension panel of said second carton lies between said first edges of said first and second walls of said second carton when said second extension panel of said second carton is folded substantially perpendicular to said second wall of said second carton towards said first wall of said second carton; said method further including the steps of:

securing said first extension panel of said first carton to said second extension panel of said first carton; and securing said first extension panel of said second carton to said second extension panel of said second carton such that said second extension panel of said second carton lies between said first extension panel of said second carton and the interior of said carton.

43. The method of claim 42 wherein said step of securing said third extension panel to said first extension panel of said second carton includes the step of securing said third extension panel to said first extension panel of said second carton with permanent adhesive;

said step of securing said first and second extension panels of said second carton together includes the step of securing said first and second extension panels of said second carton with releasable adhesive; and said step of securing said first and second extension panels of said first carton together includes the step of securing said first and second extension panels of said first carton with releasable adhesive.

44. The method of claim 39 further including the steps of:

providing a line of weakness along the line along which said first and third extension panels are joined; and positioning said line of weakness along the plane of abutment of said first and second cartons such that said first and second cartons of said dual carton are separable along said line of weakness to facilitate later separation of said first and second cartons.

45. The method of claim 44 wherein said step of providing a line of weakness comprises the step of providing a line of perforations.

46. The method of claim 39 further including the steps of:

providing said securing means with a line of weakness; and positioning said securing means such that said line of weakness is substantially parallel the adjoining abutting edges of said bottom walls to facilitate later separation of said first and second cartons.

47. The method of claim 46 wherein said step of providing said securing means with a line of weakness includes the step of providing said securing means with a line of perforations.

* * * * *